US011226096B2

(12) United States Patent
He et al.

(10) Patent No.: US 11,226,096 B2
(45) Date of Patent: Jan. 18, 2022

(54) HEATER WITH VALVE CONFIGURATION

(71) Applicant: Zhongshan GDA Gas Valve Co., Ltd., Guangdong (CN)

(72) Inventors: Jingshou He, Guangdong (CN); Huijian He, Guangdong (CN); Verlon D. Downing, Niles, IL (US)

(73) Assignee: Zhongshan GDA Gas Valve Co., Ltd., Guangdong (CN)

( * ) Notice: Subject to any disclaimer, the term of this patent is extended or adjusted under 35 U.S.C. 154(b) by 702 days.

(21) Appl. No.: 15/341,234

(22) Filed: Nov. 2, 2016

(65) Prior Publication Data

US 2018/0058692 A1 Mar. 1, 2018

Related U.S. Application Data

(60) Provisional application No. 62/379,409, filed on Aug. 25, 2016.

(51) Int. Cl.

| | |
|---|---|
| ***F23N 5/10*** | (2006.01) |
| ***F23C 1/08*** | (2006.01) |
| ***F23K 5/14*** | (2006.01) |
| ***F23N 5/24*** | (2006.01) |

(52) U.S. Cl.

CPC ..... *F23N 5/105* (2013.01); *F23C 1/08* (2013.01); *F23K 5/14* (2013.01); *F23K 5/147* (2013.01); *F23N 5/10* (2013.01); *F23N 5/24* (2013.01); *F23N 5/245* (2013.01); *F23N 2237/08* (2020.01)

(58) Field of Classification Search

CPC ... F23N 5/10; F23N 5/105; F23N 5/24; F23N 5/245; F23N 2037/08; F23C 1/08; F23K 5/14; F23K 5/147

USPC ..... 431/59

See application file for complete search history.

(56) References Cited

U.S. PATENT DOCUMENTS

2008/0223465 A1* 9/2008 Deng ..... F23D 14/00 137/625.4

2014/0272741 A1* 9/2014 Downing ..... F23D 14/10 431/280

* cited by examiner

*Primary Examiner* — Allen R. B. Schult

(74) *Attorney, Agent, or Firm* — Seyfarth Shaw LLP

(57) ABSTRACT

Disclosed is a dual-fuel heater having one or more thermocouples that operate a control valve that, in turn, controls whether fuel is distributed from a regulator to a burner based on the signal generated by the thermocouple(s). Further disclosed is a primary fuel selector valve that selects the fuel being used based on the operation of a user. The primary fuel selector valve provides fuel to the control valve upstream from the thermocouples, allowing for upstream control mechanisms such as a slave valve, to control the flow of fuel to the control valve.

12 Claims, 8 Drawing Sheets

HEATER WITH VALVE CONFIGURATION

TECHNICAL FIELD OF THE INVENTION

The present application relates generally to heaters. More particularly, the present application relates to dual-fuel heaters with a specialized valve configuration.

BACKGROUND OF THE INVENTION

Heating units, such as fireplaces, are desirable features in the home. Devices that burn non-solid materials, such as gas, or that produce heat electrically have gradually gained popularity. Like wood, the combustion of gas can provide real flames and heat, but oftentimes entails a careful mixing of gas and air for desired or optimal performance. This aspect of the gas fireplace, and similar appliances, typically involves the delivery of air for combustion to an arrangement or device where the air is mixed with gaseous fuel, e.g., natural gas (NG) and liquid propane (LP). The air and fuel are mixed at a ratio for proper combustion and then delivered to a burner element or member, and ultimately provided to a combustion chamber of the fireplace or other similar appliance. The mixing of air and fuel is oftentimes accomplished in the burner itself.

It is also advantageous to have a unit that operates on different kinds of fuel. In many homes and other buildings, there may be NG or LP fuels available. Sellers may therefore ask for a unit that can be adapted for either NG or LP, depending on what source of gas is available, or desired for the installation. Accordingly, units that can be configured to operate with more than one fuel source have been developed and are well known. These are typically referred to as "dual-source" or "dual-fuel" units. For example, the burner element may include a valve system that, when in one position, allows the unit to operate with a first fuel, and when in a second position, allows the heating unit to operate with a second fuel. These dual-fuel units are typically set up so that a choice of fuel is made by the installer when the unit is first put into operation. While dual-fuel burner units have been in the art for decades, there is always a desire to make the units simpler and more reliable to use at a lower cost.

One problem in dual-fuel heaters is that the wrong fuel can be selected at the heater. For example, a user may select the NG fuel at the heater when the fuel provided to the heater is in fact LP. This can be a dangerous mistake because the NG orifice leading to the burner is larger than the LP orifice, and the LP gas is provided at a higher pressure than the NG gas. Accordingly, selecting the NG mode when using LP gas can provide an excessively high-pressure gas through a large orifice to a burner, causing a large flame and creating an obvious safety hazard.

SUMMARY OF THE INVENTION

The disclosed embodiments broadly include a dual-fuel heater having one or more oxygen depletion sensor (ODS) thermocouple pilots capable of maintaining the opening of a control valve that in turn allows the flow of fuel to the burner. In normal operating conditions, a primary fuel selector valve can be operated by a user to choose the fuel being used. In conventional dual-fuel heaters, fuel would flow from the fuel regulator directly to the control valve and then through a selector valve mechanism to the ODS thermocouple pilots and main burner. Instead, in the disclosed embodiments fuel would flow through a multi-port fuel selector system prior to reaching the control valve. This design is more reliable than conventional heater designs because it specifically directs the flow of the selected fuel while terminating the incorrect fuel even when the incorrect fuel is chosen rather than relying on pressure or electrical mechanisms and the ODS thermocouple pilots alone for safety measures. It also allows for safety mechanisms to be implemented upstream of the control valve for added simplicity and to avoid the wrong fuel from being supplied to the incorrect pilot.

For example, the present application can include a dual-fuel system having a first regulator adapted to provide a first fuel, a second regulator adapted to provide a second fuel, a control valve that receives fuel from either the first regulator or the second regulator, and a slave valve in fluid communication between the first and second regulators and the control valve. The slave valve can selectively permit a flow of the fuel to the control valve based on input of a user. The system can further include at least one thermocouple associated with a corresponding pilot, where the thermocouple provides an electrical signal to the control valve to control whether the control valve allows the passage of fuel through the control valve. Also included is a burner, where the electrical signal causes the control valve to allow the first or second fuel to flow to the burner.

Further disclosed is a valve system including a slave valve adapted to be positioned in fluid communication between first and second regulators and a control valve. The slave valve can selectively permit the flow of the fuel to the control valve based on input of a user. Also included is a primary fuel selector valve coupled to the slave valve and that receives the input from the user to correspondingly operate the slave valve based on the input.

Also disclosed is a dual-fuel system including means for providing a first fuel, means for providing a second fuel, means for controlling a flow of fuel from the means for providing a first fuel and means for providing a second fuel, means for selectively permitting a flow of the fuel to the means for controlling a flow of fuel based on input of a user, means for providing an electrical signal to the means for controlling a flow of fuel to control whether the means for controlling a flow of fuel allows a passage of fuel through the means for controlling a flow of fuel, and means for burning the fuel. The electrical signal causes the means for controlling a flow of fuel to allow the first or second fuel to flow to the means for burning the fuel.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
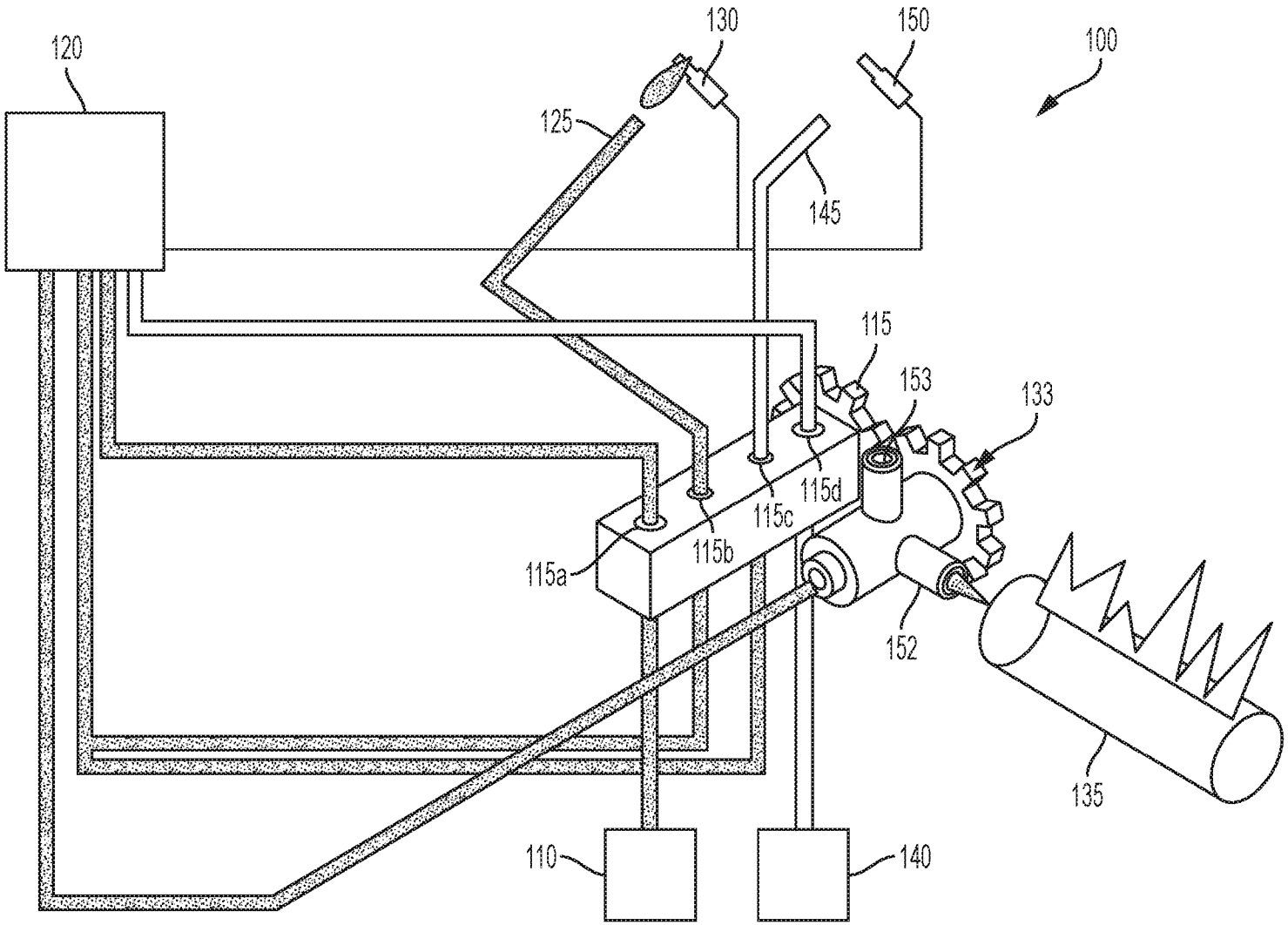
FIG. 1 is a schematic illustration of a dual-fuel system in the NG mode according to the disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the terms "present invention" and "disclosed embodiments" are not intended to limit the scope of the claimed invention and is instead a term used to discuss exemplary embodiments of the invention for explanatory purposes only.

The disclosed embodiments broadly include a dual-fuel heater having one or more ODS thermocouple pilots that operate a control valve. The control valve then controls whether fuel is distributed from a regulator to a burner based on the signal generated by the thermocouple(s). A primary fuel selector valve can be operated by a user to choose the fuel being used. The primary fuel selector valve provides fuel to the control valve upstream from the thermocouples, and is capable of blocking a passage of the fuel that is not chosen, either alone or with other mechanisms such as a slave valve. This allows for a simpler design that provides the fuel to the control valve prior to the thermocouples, and that further allows for upstream control mechanisms such as a slave valve, to control the flow of fuel to the control valve.

FIGS. 1-4 illustrate a first embodiment of the disclosed embodiments while FIGS. 5-8 illustrate a second embodiment of the disclosed embodiments. For example, FIGS. 1-4 can relate to a wall heater design, whereas FIGS. 5-8 can relate to a fireplace, gas log, or stove design. However, both embodiments can be implemented in any appliance or machine without departing from the spirit and scope of the present invention.

FIG. 1 illustrates a dual-fuel system 100 in the NG mode. As shown, the system provides NG fuel from an NG regulator 110, through the slave valve 115, and to the control valve 120. The control valve 120 then provides fuel to the NG pilot 125 so that the NG pilot 125 can heat the associated NG thermocouple 130. If the NG pilot 125 generates a sufficient amount of heat, the NG thermocouple 130 will generate and send a signal, for example 300 milliamps, to the control valve 120. A primary fuel selector valve 133 can provide a selectable knob, switch, or other interface to select whether the system 100 is to operate in the NG or LP mode.

The control valve 120 includes, for example, a solenoid valve that opens or remains open upon the application of a predefined amount of current, for example, 200 milliamps. If the NG thermocouple 130 generates more than the requisite amount of current, the solenoid valve will open or remain open and allow fuel to be provided to a burner 135. If the NG thermocouple 130 does not provide sufficient current or another sufficient signal, the solenoid valve will close and will no longer provide fuel to the burner 135. In some embodiments, the solenoid valve is coupled to a thermal switch, where the thermal switch will instantaneously close the solenoid valve upon the thermal switch reaching a specific minimum allowed temperature. These safety mechanisms are implemented in heaters to protect against the pilot flame going out or not combusting sufficient fuel, in which case the flammable fuel will be emitted into the surrounding home or other structure and cause a gas leak. The solenoid valve blocks such a leak from occurring by closing off supply of the fuel when the fuel is not properly combusted.

Figure 2:
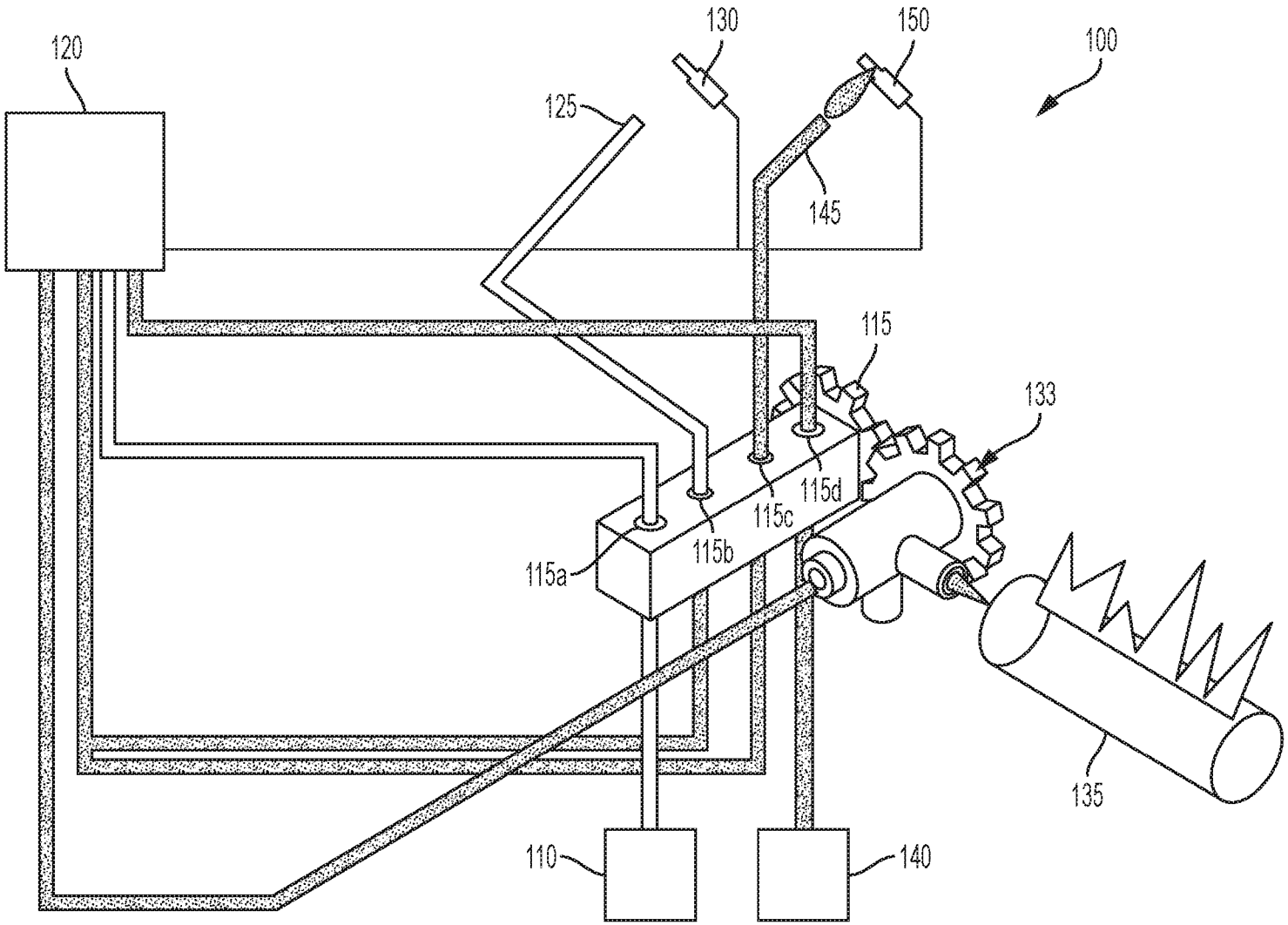
FIG. 2 is a schematic illustration of a dual-fuel system in the LP mode according to the disclosed embodiments.

FIG. 2 illustrates the same design as FIG. 1 but where the system 100 is in the LP mode. As shown, the system 100 provides fuel from the LP regulator 140 to the control valve 120, which then provides the fuel to an LP pilot 145 and LP thermocouple 150 so as to provide a current to the control valve 120 to determine whether to provide fuel to the burner 135. Fuel is then provided to the burner 135 and ignited.

Figure 3:
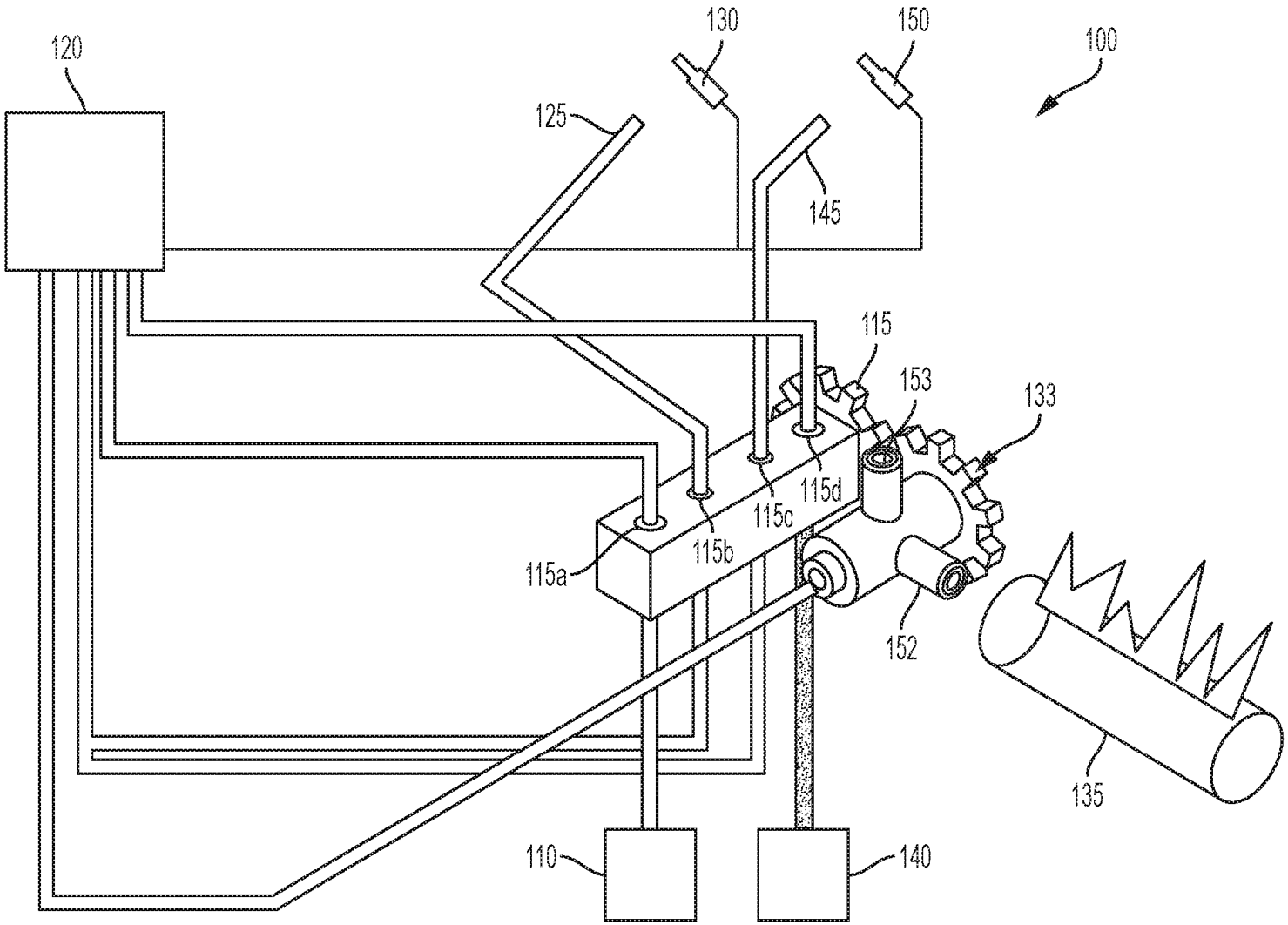
FIG. 3 is a schematic illustration of a dual-fuel system in the "wrong fuel" mode (LP regulator but NG mode selected) according to the disclosed embodiments.

FIG. 3 illustrates the same design as FIGS. 1 and 2 but where the fuel selected at the primary fuel selector valve 133 is not the same as the fuel actually provided from the regulator. Here, the selected fuel is NG but the system 100 is operating in the LP mode. This is a dangerous orientation because an NG orifice 152 leading to the burner 135 is larger than the LP orifice 153, but the LP fuel is emitted at a higher pressure, leading potentially to a large flame and unsafe condition. The system 100, however, blocks the LP fuel from reaching the control valve 120 by providing the slave valve 115 that prevents the flow of the LP fuel just after the regulator 110, 140. That is, the slave valve 115 includes four separate passages 115*a, b, c, d* that can each be opened or closed. In some embodiments, the first passage 115*a* would block the flow of fuel from the NG regulator 110 to the control valve 120. The second passage 115*b* would block the flow of fuel from the control valve 120 to the NG pilot 125. The third passage 115*c* would block the flow of fuel from the control valve 120 to the LP pilot 145. The fourth passage 115*d* would block the flow of fuel from the LP regulator 140 to the control valve 120. In various embodiments, the various passages can be blocked, either singularly or in combination with each other.

The fourth passage 115*d* is closed in the illustration shown in FIG. 3. That is, when the NG mode is selected at the primary fuel selector valve 133, the slave valve 115 is rotated so as to block the fourth passage 115*d* and prevent the flow of LP fuel to the control valve 120. In so doing, the LP fuel is not emitted from a larger NG orifice 152 at the higher LP pressure and therefore does not create a dangerous flame. As shown, this mechanism can be entirely mechanical, but it is contemplated that electrical valve components or pressure-based controllers can be implemented within the spirit and scope of the present invention.

As shown in FIGS. 1-3, the selector valve 133 can include a round, tubular body that distributes the gas through first 152 and second 153 orifices to the burner 135. The orifices 152, 153 can be placed on sides of this body, as shown in FIGS. 1-3, where axial rotation of the selector valve 133 can cause the appropriate orifice 152, 153 to align with and direct gas into the burner 135. This design allows for more precise positioning and alignment with the burner tube and improves combustion efficiency. The design further allows for the orifices 152, 153 to be placed on perpendicular, or even opposite, sides of the body making the valve more flexible or universal to fit a variety of appliance styles or design types. In addition, the orifice can be configured with different size openings making it very simple to change the heat output of the appliances by merely changing only the orifices and not the complete selector valve.

Figure 4:
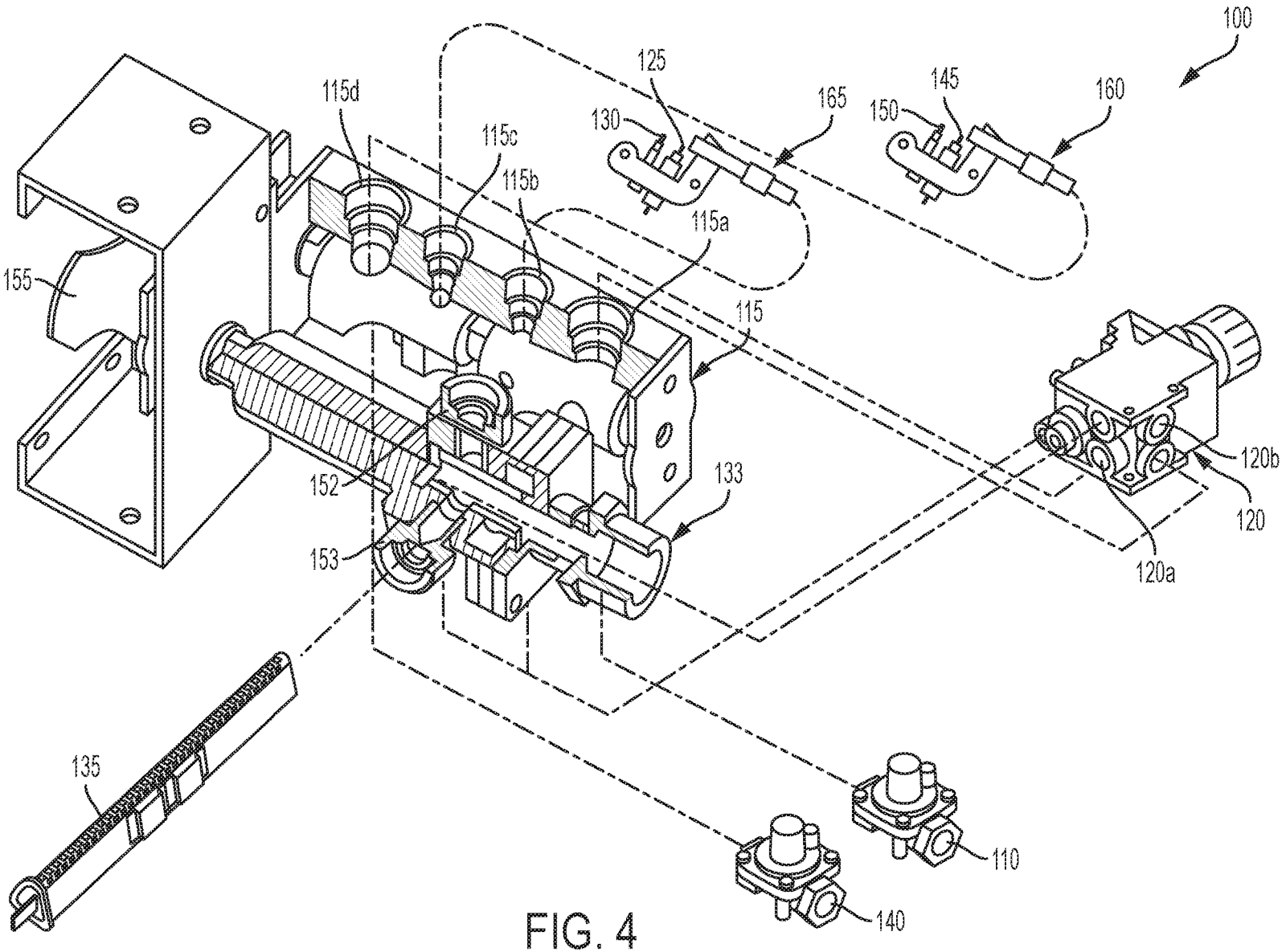
FIG. 4 is a partial sectional view of a dual-fuel system illustrating components of the disclosed embodiments.
Figure 5:
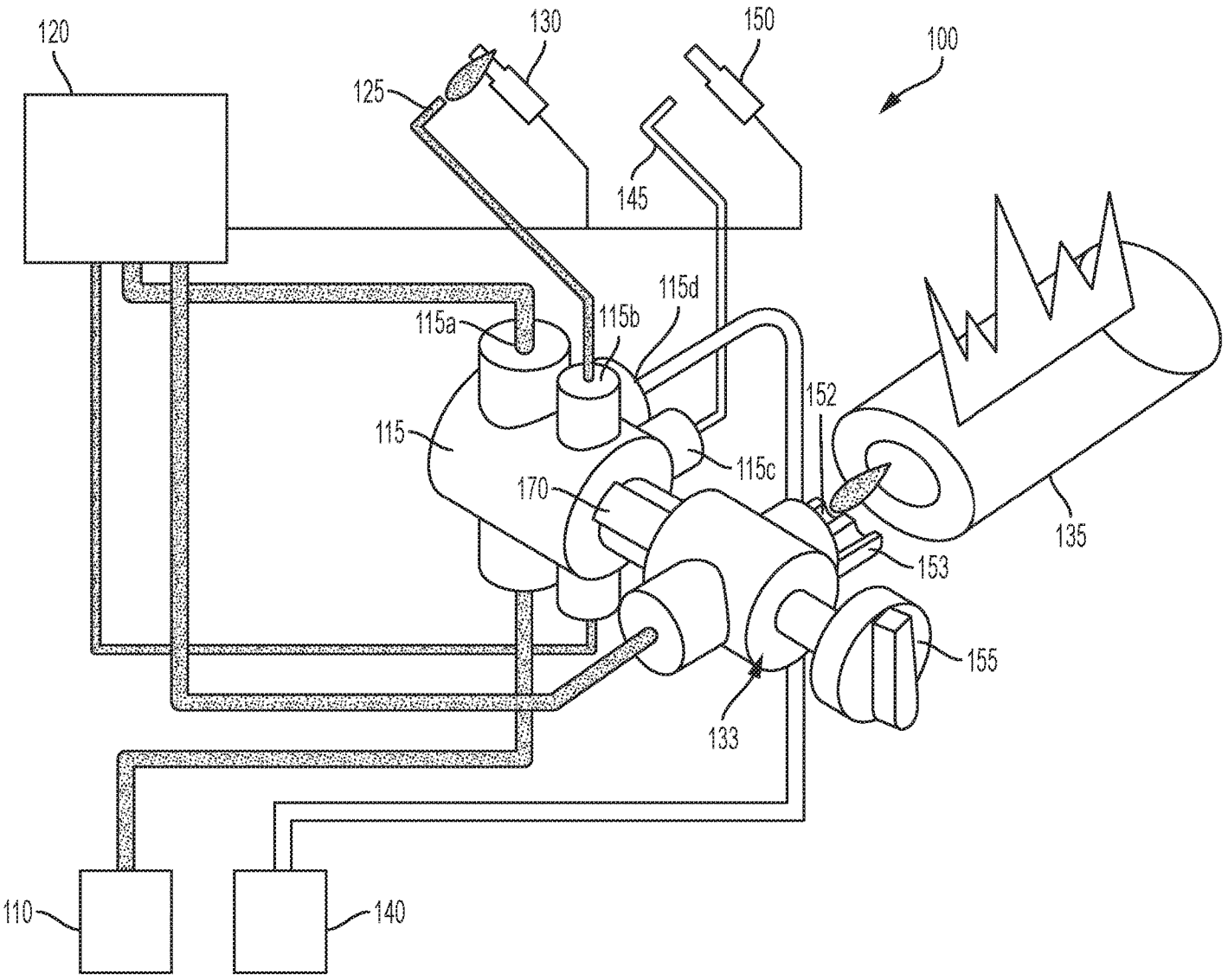
FIG. 5 is a schematic illustration of a dual-fuel system in the NG mode according to other embodiments of the present application.
Figure 6:
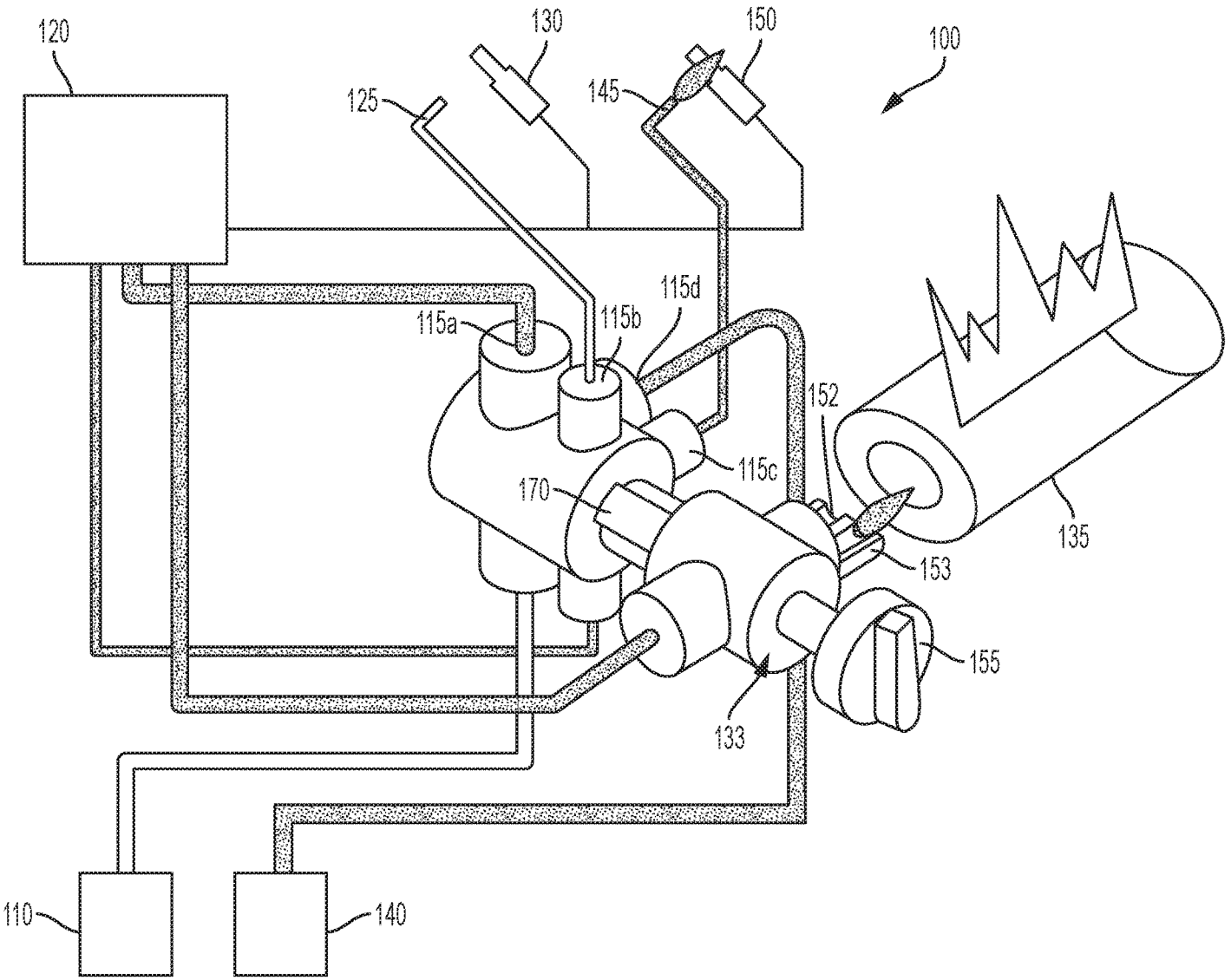
FIG. 6 is a schematic illustration of another dual-fuel system in the LP mode according to the disclosed embodiments.
Figure 7:
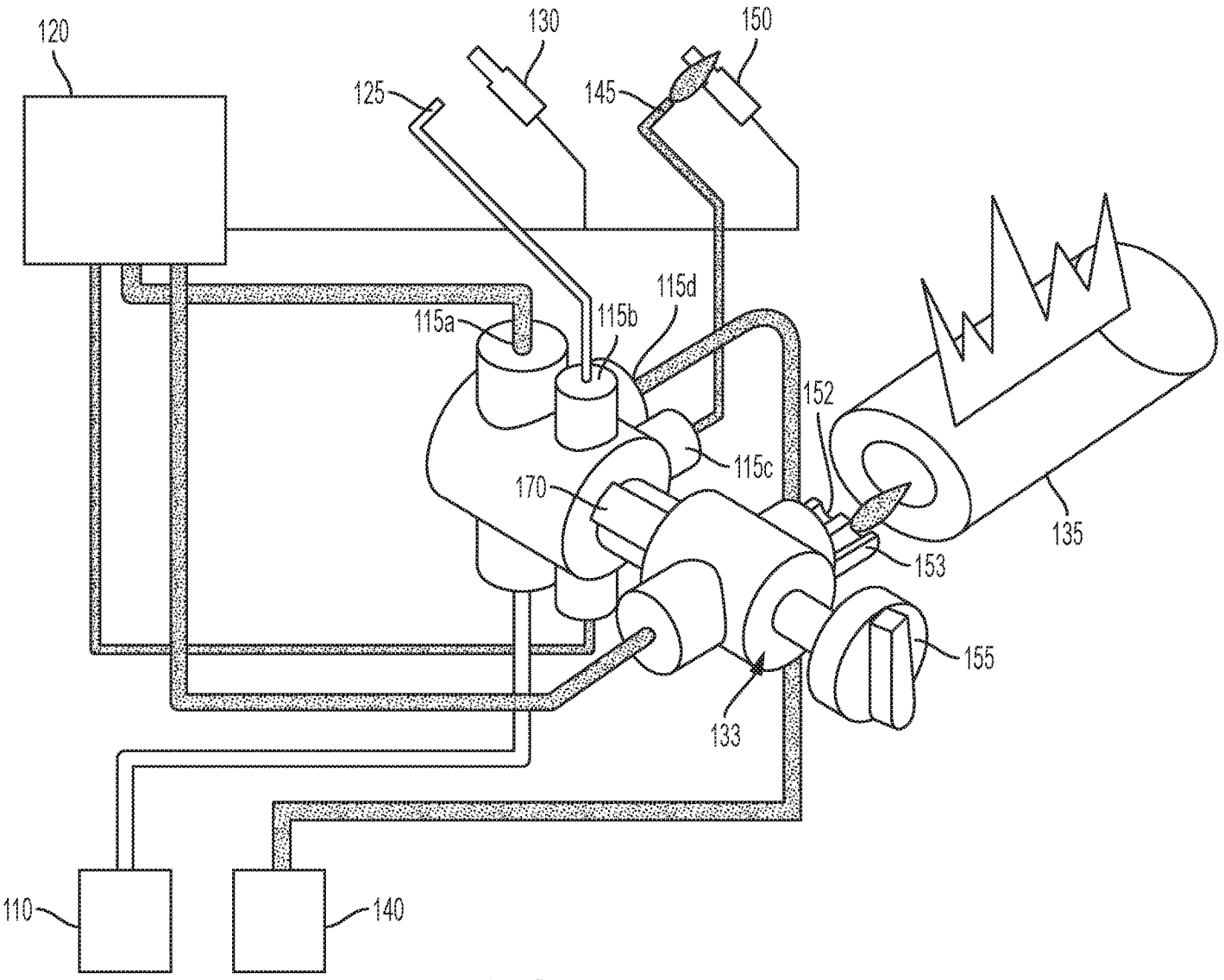
FIG. 7 is a schematic illustration of another dual-fuel system in the "wrong fuel" mode (LP regulator but NG mode selected) according to the disclosed embodiments.

FIG. 4 illustrates a partial sectional view of the system according to embodiments of the present application. As shown, a selector knob 155 is provided on a base of the system 100 to control the selector valve 133 and, by extension, the slave valve 115. The selector knob 155 can be turned by a user to select the appropriate fuel to be used for the system. The fuel can then be provided by either the LP 140 or NG regulator 110 based on the selection, and the selected fuel can then flow through the slave valve 115 and to inlets 120*a, b* on the control valve. The control valve 120 can then provide the fuel to one of two ODS units 160, 165. Two such ODS units are provided, one for LP fuel (the LP ODS 160) and another for NG fuel (the NG ODS 165). The control valve 120 can then provide the fuel back to the selector valve 133 and to the burner 135 for ignition. As shown, the slave valve 115 can have four passages 115*a, b, c, d*, as discussed above.

FIGS. 5-8 illustrate a second embodiment 200 that controls the flow of fuel similar to the system 100 described above, with like elements represented in like numerals. As discussed, the system 100 can typically be used for wall heaters while the second embodiment 200 can be used for gas logs, fireplaces, and stoves, although the present invention is not so limited.

Figure 8:
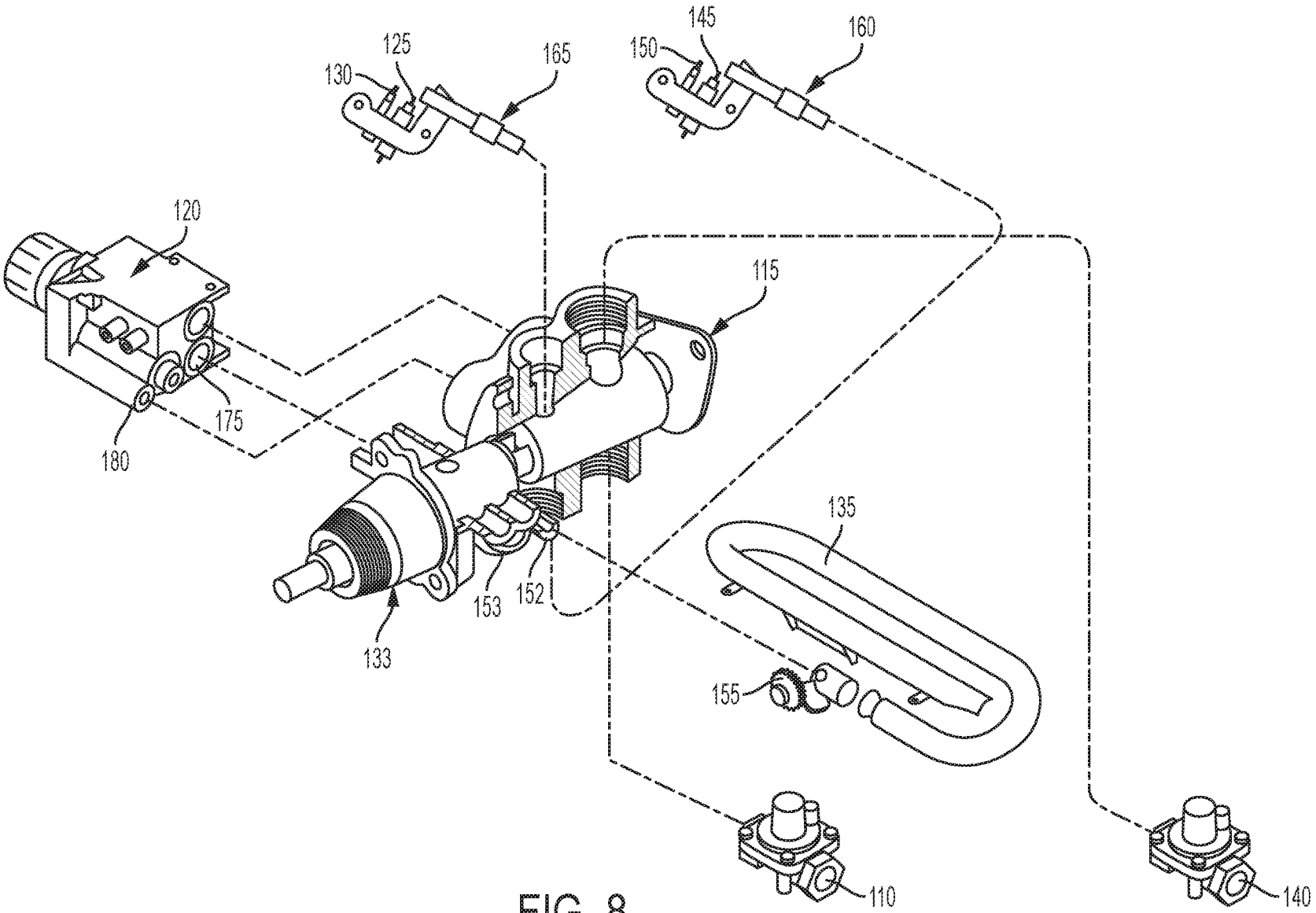
FIG. 8 is a partial sectional view of a dual-fuel system illustrating components of the disclosed embodiments.

The second embodiment 200 is similar to the system 100 described above, but includes two passages 115*c, d* located on a side of the slave valve 115, and orifices 152, 153 leading to the burner 135 in a parallel or side-by-side configuration. The slave valve 115 and primary fuel selector valve 133 can also be coupled together by a coupling 170, or in some embodiments, can be integral with one another. As shown in FIG. 8, the control valve 120 can include a first outlet 175 leading to the burner 135, and a second outlet 180 leading to the LP ODS 160 and NG ODS 165 via the slave valve 115, rather than two outlets leading to the ODS systems and two additional outlets leading to the burner 135. That is, the first outlet 175 can lead to the slave valve 115, where the selected fuel is directed to the appropriate orifice 152, 153 based on which fuel is selected at the primary fuel selector valve 133. Also, the second outlet 180 can lead to the slave valve 115, which will direct the fuel to the appropriate ODS 160, 165, again based on the fuel selected at the primary fuel selector valve 133. The first 175 and second 180 outlets can therefore be fluidly connected to the burner 135 and oxygen depletion sensors 160, 165 via the slave valve 115, although the present invention is not so limited.

The invention has been discussed herein as being a dual-fuel system for NG and LP fuel. However, the invention is not so limited to the disclosed fuels, and can be implemented with any fuel without departing from the spirit and scope of the present application.

As discussed herein, the term "coupled" is intended to refer to any connection, direct or indirect, and is not limited to a direct connection between two or more elements of the disclosed invention. Similarly, "operatively coupled" is not intended to mean any direct connection, physical or otherwise, and is merely intended to define an arrangement where two or more elements communicate through some operative means (e.g., through conductive or convective heat transfer, or otherwise). The term "coupled" can mean, in some embodiments, two objects being integral with one another.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A dual-fuel system comprising:

a first regulator adapted to provide a first fuel;

a second regulator adapted to provide a second fuel;

a control valve that receives the fuels from either the first regulator or the second regulator;

first and second thermocouples respectively associated with first and second pilots and the first and second regulators, the first and second thermocouples providing an electrical signal to the control valve to control whether the control valve allows passage of the fuels through the control valve;

a burner, wherein the electrical signal causes the control valve to allow the fuels to flow to the burner;

a slave valve selectively permitting a flow of the fuels to the control valve and to the first and second pilots based on input of a user, the slave valve having a first passage that selectively permits passage of the first fuel from the first regulator to the control valve, a second passage that selectively permits passage of the first fuel from the control valve to the first pilot, a third passage that selectively permits passage of the second fuel from the control valve to the second pilot, and a fourth passage that selectively permits passage of the second fuel from the second regulator to the control valve, at least the first and fourth passages being dedicated passages such that the first fuel flowing through the first passage does not flow through any portion of the fourth passage; and a primary fuel selector valve that receives the input from the user and correspondingly operates the slave valve based on the input, the primary fuel selector valve receiving the fuel from the control valve and providing the fuels to the burner.

2. The system of claim 1, wherein the primary fuel selector valve is mechanically coupled to the slave valve to facilitate operation of the slave valve when the primary fuel selector valve is operated.

3. The system of claim 1, wherein the primary fuel selector valve includes a first orifice associated with the first fuel, and a second orifice associated with the second fuel, the first and second orifices leading to the burner.

4. The system of claim 3, wherein the first orifice is larger than the second orifice.

5. The system of claim 1, wherein the first regulator emits the first fuel at a lower pressure than the second regulator emits the second fuel.

6. The system of claim 1, wherein the control valve includes an outlet communicating directly with the primary fuel selector valve.

7. The system of claim 3, wherein the first and second orifices are parallel to one another.

8. The system of claim 3, wherein the first and second orifices are positioned on different sides of the primary fuel selector valve.

9. The dual-fuel system of claim 1, wherein the slave valve includes a first gear, the primary fuel selector valve includes a second gear, and wherein the input from the user causes the second gear to cooperate with the first gear and rotate the first gear so as to selectively allow passage of the fuels through the first, second, third, and fourth passages of the slave valve.

10. A dual-fuel system comprising:

a first regulator adapted to provide a first fuel;

a second regulator adapted to provide a second fuel;

a control valve that receives the fuels from either the first regulator or the second regulator;

first and second thermocouples respectively associated with first and second pilots and the first and second regulators, the first and second thermocouples providing an electrical signal to the control valve to control whether the control valve allows passage of the fuels through the control valve;

a burner, wherein the electrical signal causes the control valve to allow the fuels to flow to the burner;

a slave valve selectively permitting a flow of the fuels to the control valve and to the first and second pilots based on input of a user, the slave valve having a first passage that selectively permits passage of the first fuel from the first regulator to the control valve, a second passage that selectively permits passage of the first fuel from the control valve to the first pilot, a third passage that selectively permits passage of the second fuel from the control valve to the second pilot, and a fourth passage that selectively permits passage of the second fuel from the second regulator to the control valve;

a primary fuel selector valve that receives the input from the user and correspondingly operates the slave valve based on the input, the primary fuel selector valve receiving the fuel from the control valve and providing the fuels to the burner through a first or second outlet orifice exiting the primary fuel selector valve, wherein the input causes the primary fuel selector valve to rotate and to thereby align one of the first or second outlet orifices with the burner.

11. The dual-fuel system of claim 10, wherein the first and second orifices are integrally formed within the primary fuel selector valve and direct the fuels directly to the burner when aligned with the burner based on input from the user.

12. The dual-fuel system of claim 10, wherein the slave valve includes a first gear, the primary fuel selector valve includes a second gear, and wherein the input from the user causes the second gear to cooperate with the first gear and rotate the first gear so as to selectively allow passage of the fuels through the first, second, third, and fourth passages of the slave valve.

* * * * *